US008640902B2

(12) United States Patent
Tirosh et al.

(10) Patent No.: US 8,640,902 B2
(45) Date of Patent: Feb. 4, 2014

(54) DRINKING CONTAINER VENT SYSTEM AND METHOD

(76) Inventors: Tamir Tirosh, Menahemia (IL); Amikam Berkovitch, Hertfordshire (GB)

( * ) Notice: Subject to any disclaimer, the term of this patent is extended or adjusted under 35 U.S.C. 154(b) by 1262 days.

(21) Appl. No.: 10/593,429

(22) PCT Filed: Mar. 17, 2005

(86) PCT No.: PCT/IL2005/000309

§ 371 (c)(1),
(2), (4) Date: Jun. 3, 2008

(87) PCT Pub. No.: WO2005/089060

PCT Pub. Date: Sep. 29, 2005

(65) Prior Publication Data

US 2008/0302793 A1 Dec. 11, 2008

Related U.S. Application Data

(60) Provisional application No. 60/554,604, filed on Mar. 19, 2004, provisional application No. 60/585,704, filed on Jul. 6, 2004, provisional application No. 60/585,782, filed on Jul. 6, 2004, provisional application No. 60/609,790, filed on Sep. 14, 2004, provisional application No. 60/617,375, filed on Oct. 8, 2004.

(51) Int. Cl.
*A61J 11/02* (2006.01)
*B65D 51/16* (2006.01)

(52) U.S. Cl.
USPC ..... 220/203.11; 215/11.5; 220/373; 220/714

(58) Field of Classification Search
USPC ..... 220/203.29, 374, 373, 714, 203.11; 215/11.5
See application file for complete search history.

(56) References Cited

U.S. PATENT DOCUMENTS

| | | | | |
|---|---|---|---|---|
| 2,061,477 A | | 11/1936 | Perry | |
| 3,059,797 A | * | 10/1962 | Wilkinson et al. | 215/11.1 |
| 5,570,796 A | * | 11/1996 | Brown et al. | 215/11.5 |
| 5,678,710 A | * | 10/1997 | Sheu | 215/11.5 |

(Continued)

FOREIGN PATENT DOCUMENTS

| | | |
|---|---|---|
| CN | 1197385 | 10/1998 |
| DE | 19849271 | 4/2000 |

(Continued)

OTHER PUBLICATIONS

International Search Report of International App. No. PCT/IL2005/000309.

*Primary Examiner* — Mickey Yu
*Assistant Examiner* — Niki Eloshway
(74) *Attorney, Agent, or Firm* — Deborah Gador

(57) ABSTRACT

The present invention relates to a drinking apparatus including a vent system that removably connects to a drinking container. The vent system is used to form a variety of leak free and essentially vacuum-free drinking containers. The vent system, includes a closure member and a valve, and may be used with an anti-bubble tube. The closure member may be a single member or may be formed of two portions. The valve may be coupled thereto or integrally formed therewith. The anti-bubble tube and valve function as a diving bell to generally prevent liquid from entering the anti-bubble tube.

13 Claims, 15 Drawing Sheets

(56) References Cited

U.S. PATENT DOCUMENTS

| | | | | |
|---|---|---|---|---|
| 5,720,555 | A | 2/1998 | Elele | |
| 5,749,483 | A | 5/1998 | Tebeau | |
| 5,779,071 | A | 7/1998 | Brown et al. | |
| 7,204,380 | B2 * | 4/2007 | Webb et al. | 215/11.4 |
| 2004/0035815 | A1 | 2/2004 | Webb et al. | |
| 2004/0089626 | A1 * | 5/2004 | Pyun | 215/11.5 |
| 2005/0236353 | A1 * | 10/2005 | Hsu | 215/11.5 |
| 2005/0258124 | A1 * | 11/2005 | Brown et al. | 215/11.1 |
| 2006/0124573 | A1 * | 6/2006 | Nachumi | 215/11.5 |

FOREIGN PATENT DOCUMENTS

| | | |
|---|---|---|
| DE | 20210121 | 11/2002 |
| JP | 2003038617 | 2/2003 |
| KR | 200166539 | 2/2000 |
| KR | 20020046249 | 12/2001 |
| KR | 20030085468 | 4/2002 |
| KR | 20020046248 | 6/2002 |
| KR | 20023-60185 | 8/2003 |
| KR | 200360185 | 11/2006 |
| RU | 216028 | 12/2008 |

* cited by examiner

A-A

DRINKING CONTAINER VENT SYSTEM AND METHOD

This Application claims the benefit of U.S. Provisional Patent Application No. 60/554,604 filed Mar. 19, 2004; U.S. Provisional Patent Application No. 60/585,782 filed Jul. 6, 2004; U.S. Provisional Patent Application No. 60/585,704 filed Jul. 6, 2004; U.S. Provisional Patent Application No. 60/609,790 filed Sep. 14, 2004; and U.S. Provisional Patent Application No. 60/617,375 filed Oct. 8, 2004.

FIELD OF THE INVENTION

The present invention relates to a drinking container, a drinking apparatus, and methods of providing flow through the containers and apparatus for use with leak free and essentially vacuum-free toddler drinking cups and baby bottles.

DESCRIPTION OF RELATED ART

Specialized baby bottles are manufactured with features that are designed to attempt to reduce colic symptoms in infants from zero months to approximately four months. Notably, U.S. Pat. Nos. 5,570,796 and 5,779,071 state that their designs eliminate the mixing of air into the formula as this increases the risk of colic symptoms.

The apparatus described in U.S. Pat. Nos. 5,570,796 and 5,779,071 includes a reservoir having a reservoir tube in combination with a liquid trap. An insert used in conjunction with the reservoir provides passage for air from the exterior of a bottle to the interior of the bottle. When the bottle incorporating the features of these patents is fully inverted, the liquid trap contains the liquid from inside the reservoir tube, and prevents the liquid from entering an opening of the insert since the opening of the insert is above the level of the liquid contained in the liquid trap. It is important to note that the volume of the liquid trap is larger than the volume of the reservoir tube, and thus, the liquid may be fully contained in the liquid trap under a narrow window of operating conditions.

Unfortunately, the apparatus described in U.S. Pat. Nos. 5,570,796 and 5,779,071 suffers from leakage when the bottle is overfilled since then the reservoir tube and the liquid trap described therein becomes filled with liquid beyond the capacity of the liquid trap allowing liquid to enter the insert and eventually to the exterior of the bottle. Additionally, the apparatus described in these patents suffers from leakage when the bottle is squeezed or the nipple attached to the bottle is squeezed. Further, the bottles described in these patents will leak when the bottle is shaken to mix a formula, if the liquid is heated to above 45° C., or if the bottle is subjected to changes in atmospheric pressure.

Importantly, colic symptoms are generally a concern for newborns, such as those children in the ages of zero to four months. As used herein, the age ranges are given in general terms and are not meant to set definite boundaries as to when certain baby bottles or certain non-spill toddler drinking cups are appropriate.

Also, a bottle that requires a child older than four months to exert too much "sucking" action on the nipple of the bottle may result in an increased likelihood of the child developing an ear infection.

SUMMARY OF THE INVENTION

The present invention relates to a drinking container, a drinking apparatus, and methods of providing flow through the containers and apparatus for use with leak free and essentially vacuum-free toddler drinking cups and baby bottles.

As used herein, "essentially vacuum-free" means that liquid in the container exits the container through the nipple or spout when the container is inverted or placed at an angle. The closure member provides venting to the atmosphere surrounding the container and provides the essentially vacuum-free operation. "Essentially vacuum-free" operation or "nearly vacuum-free" operation provides for a container that does not require an added sucking force to be applied by the user of the container to receive liquid from the container. Further, no appreciable vacuum force is created in the container during use of the container due to the venting. It will be understood by one of ordinary skill in the art that a liquid exiting a container will create a minimal vacuum force. This minimal vacuum force created using the container of present invention draws air into the container from the surrounding atmosphere until equilibrium between the atmosphere and the interior of the container is created. The definitions set forth herein for "essentially vacuum-free" or "nearly vacuum-free" contemplate that a minimal vacuum force will be created to draw air into the container as the liquid is exiting the container. All of the embodiments of the present invention operate in an essentially vacuum-free manner.

As used herein, "leak free" means that the container is free from leaks through the closure member. Since the closure member provides venting, the valve is necessary to prevent leakage through the closure member. All of the embodiments of the present invention operate in a leak free manner.

As used herein, "non-spill" refers to spillage via the nipple or the spout of the container. Certain embodiments of the present invention operate in a non-spill manner.

A first embodiment of the present invention relates to a drinking apparatus, comprising: a valve that sealingly and removably connects to a closure member for a drinking container. The valve is simple to clean and may be economically replaced should the user not desire to clean the valve. For purposes of the present invention, a closure member is any element arranged to sit on or in the open top of a drinking container, which is not a nipple or spout or other liquid outlet, and through which air passes from outside the container into the container. According to some embodiments, the closure member includes liquid passages for liquid to flow from inside the container to the liquid outlet. According to other embodiments, the liquid flows from the interior of the container around the closure member to the outlet. One example of a closure member is the insert used in U.S. Pat. No. 5,570,796 described above.

The valve and the closure member are used together in a variety of non-spill, leak free, and/or essentially vacuum-free drinking containers, such as toddler drinking cups, baby bottles, and other drinking containers. The closure member allows an infant drinking from a bottle of the present invention to easily drink from a nipple or spout attached to the bottle without appreciably increasing the vacuum force inside the bottle. However, importantly, the valve connected to the closure member prevents the leakage of liquid from the bottle via the closure member when the bottle is in an inverted or sideways position since the valve prevents the flow of liquid into the closure member. The valve is designed such that increased exertion to create a high degree of suction force is not necessary for liquid to flow from the bottle and thus the likelihood of causing an ear infection in the user from such over exertion is reduced.

A second embodiment of the present invention relates to a vent system, comprising: a valve sealingly and removably connectable to the closure member of the first embodiment, and an additional anti-bubble tube. This vent system attaches or connects to an opening or a mouth of the drinking container and provides passage for air from the exterior of the drinking container to the interior of the drinking container. The valve and the anti-bubble tube act as a "diving bell" and generally prevent liquid from entering the anti-bubble tube when the drinking container is in a substantially upright position, since air is trapped in anti-bubble tube with no escape until the valve is opened, i.e., the trapped air acts as a barrier preventing liquid from entering the anti-bubble tube. The diving bell effect is created by the user of the container when the user places the closure member (with the valve and the anti-bubble tube attached) into the container. When the container is inverted and liquid exits from the container, as soon as a vacuum force is created inside the container, the valve is opened and air enters the container. As air is drawn into the container, the valve releases the "new" air into the anti-bubble tube and into the volume of trapped air. This "new" air may displace some of the trapped air, thus forcing the trapped air through the anti-bubble tube. In this position, the "diving bell" effect is not maintained in the anti-bubble tube. In any event, the anti-bubble tube is shaped and coupled to the closure member in such a way as to allow only a very small amount of liquid to enter the anti-bubble tube. Thus, the liquid does not cover the valve and, despite the absence of the diving bell effect, the bottle still operates in a leak-free manner.

As in the first embodiment, the valve connects or attaches to the closure member, as does the anti-bubble tube. The valve allows the air to enter the container, but it does not allow liquid to exit the container via the vent system. The anti-bubble tube provides for air entering the inverted container to reach an air pocket formed in the bottom portion of the container, which, during the use of the container, is raised above a nipple or a spout of the container. The air pocket is created by air entering the container through the valve in response to the emptying of the container through the nipple or the spout by the drinker. By providing passage for the air directly to the air pocket, the air is not allowed to mix with the liquid in the container and create air bubbles in the liquid. The anti-bubble tube is important for use by newborns, since they are at a greater risk for colic than older children. However, as children outgrow instances of colic, the present invention allows the user to remove the anti-bubble tube (leaving the valve and the closure member) and still maintain a functional bottle or cup for the older children.

In an alternative embodiment, the present invention further relates to a drinking apparatus comprising a vent system having a closure member formed of several parts, and comprising a disc portion and a base portion. The base portion is coupled to or includes a one-way valve as an integral portion thereof. This closure member functions in substantially the same fashion as that of the first embodiment. Multiple embodiments for the closure member are described herein, including a preferred embodiment with a duck-bill valve. An optional anti-bubble tube may be used with the vent system of this embodiment.

Like other embodiments, the vent system with the disc portion and the base portion attach to certain readily available containers in the baby bottle industry. Moreover, the vent system with the disc portion and the base portion is particularly simple to clean since all regions of the base portion and the disc portion are readily accessible without requiring specialized cleaning equipment. Thus, the vent system of these embodiments provides full access to various components of the vent system for cleaning. Additionally, the various components of the vent system may be visually inspected for cleanliness.

In other embodiments of the present invention, the valve and closure member may be used in conjunction with a "sippy cup" and spout for use by toddlers. The sippy cup may also include a flexible spout.

In addition to baby bottles and sippy cups, the apparatus of the present invention may be used with non-spill containers for people of all ages. For example, bicyclists and other athletes and sports participants may benefit from using a substantially vacuum-free, non-spill container.

It is an aspect of the present invention to provide a leak-free and essentially vacuum-free drinking container that may be used at nearly any angle without leaking.

It is another aspect of the present invention to provide an essentially vacuum-free container with fewer parts and simpler operation than the prior art.

It is an aspect of the present invention to provide a leak-free and essentially vacuum-free baby bottle that may be filled with hot or boiling water.

It is an aspect of the present invention to provide a leak-free and essentially vacuum-free drinking container that may be filled with liquid and shaken vigorously without leaking.

These and other aspects of the present invention are achieved herein.

DETAILED DESCRIPTION OF THE PREFERRED EMBODIMENTS

The present invention will now be described relative to the first embodiment directed to a vent apparatus for a drinking container. The vent apparatus includes a one-way valve sealingly and removably coupled to a closure member for closing the drinking container. The present invention will then be described relative to a second embodiment that includes an anti-bubble tube with the vent apparatus of the first embodiment. Both the first and the second embodiments have various configurations within the scope of the present invention.

In a first embodiment, the present invention is directed to a vent apparatus that provides non-spilt leak-free, and/or essentially vacuum-free drinking containers, such as a baby bottle, a sippy cup, or other non-spill drinking vessels used by adolescents and adults. The vent apparatus includes a one-way valve configured to sealingly connect to a closure member for use with a drinking container. The valve includes an opening to allow air to pass from the atmosphere surrounding the drinking container to the interior of the drinking container, but which prevents liquid from the interior of the drinking container from leaking out through the vent apparatus.

It will be appreciated that, with the addition of a suitable one-way valve, certain commercially available closure members currently in use with baby bottles may be converted to vent apparatus according to the present invention. Generally, the closure member is held into or onto the drinking container via a collar. The closure member includes an air vent tube or channel that connects to the valve and provides an air passage into the container from the atmosphere surrounding the drinking container via the space between the container and the collar. Thus, the closure member provides for the essentially vacuum-free operation.

Figure 1:
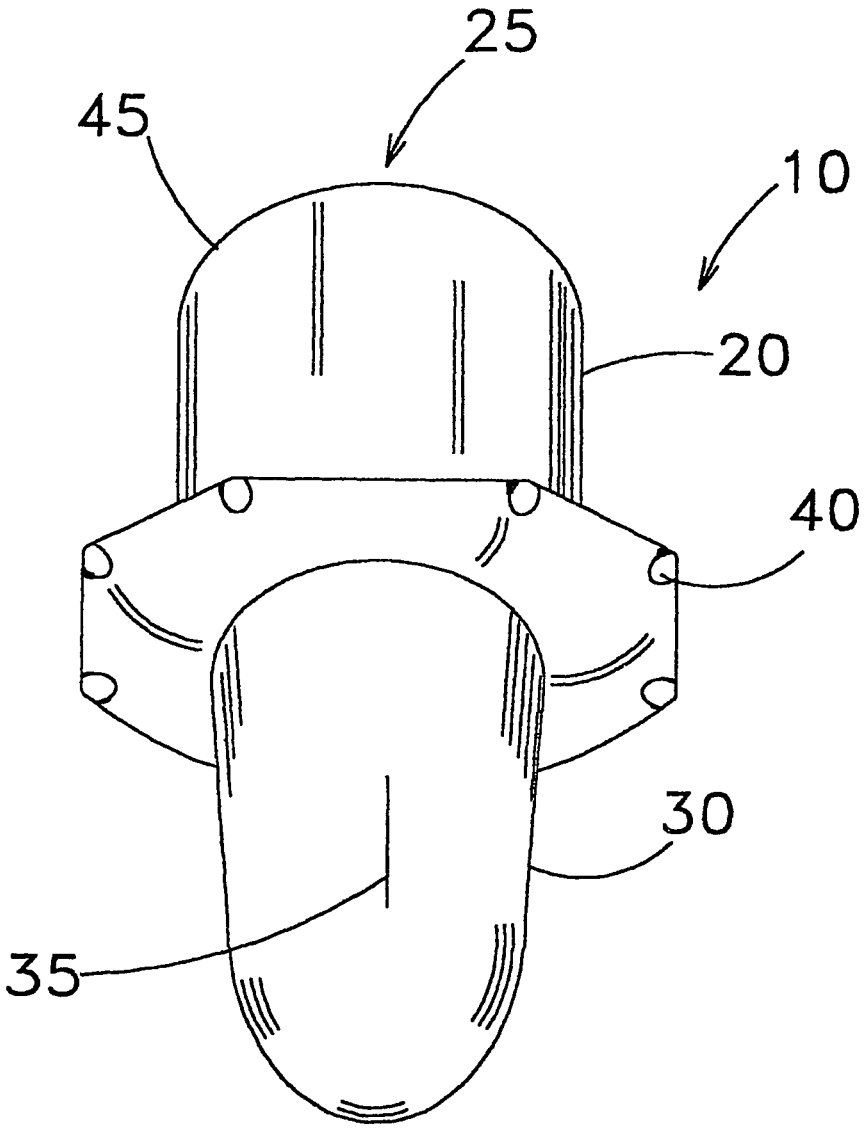
FIG. 1 is perspective view of a valve for use in a vent system of one embodiment of the invention.

The first embodiment of the present invention will now be described with reference to FIG. 1, which shows a one-way valve 10 for use in a vent system of the present invention. The valve 10 is adapted and configured for detachable coupling to a closure member (not shown). In the embodiment illustrated in FIG. 1, the valve 10 includes a connecting portion 20 for sealingly connecting the valve to the closure member. The connecting portion 20 has a circular opening 25. The circular opening 25 is adapted and configured to receive a connecting element 150 of a closure member 90, here illustrated as a drop tube (shown in FIG. 2). Walls 45 of the connecting portion 20 are adapted and configured to tightly grip the connecting element 150, to prevent the valve from inadvertently falling into the container during shaking or drinking. The connecting element 150 is inserted into the circular opening 25 and the walls 45 stretch slightly and then squeeze to accommodate and hold the connecting element 150. The walls 45 should be of sufficient thickness such that they securely grip to the connecting element 150. For example, the walls 45 may be between approximately two (2) millimeters to approximately three (3) millimeters thick. If desired, means for improving adhesion between the valve and the connecting element during drinking may be provided, such as raised portions on one that correspond to depressions on the other, or complementary ridges and grooves, or a reinforcing collar. However, it will be appreciated that the valve should be easily removable from the closure member for cleaning.

The valve 10 also includes a bottom portion 30, which includes an opening or slit 35. Opening 35 is designed to provide relatively easy passage for air from the interior of the valve to the container, while substantially preventing passage of liquid from the container to the interior of the valve.

In between the bottom portion 30 and the connecting portion 20, the valve 10 includes a gripping portion, here illustrated as a ring 40. The ring 40 provides a region that is easily gripped by the user of the valve 10 such that the valve 10 may be pulled from the closure member under wet conditions for cleaning. The ring 40 may be of any shape, such as a square, an octagon or circle so long as it provides friction for the user.

The valve 10 may be made from a variety of plastic/rubber materials, such as silicone and thermoplastic rubber. An especially preferred material for the valve 10 is silicone. The valve 10 must be made of a nontoxic material.

Figure 2:
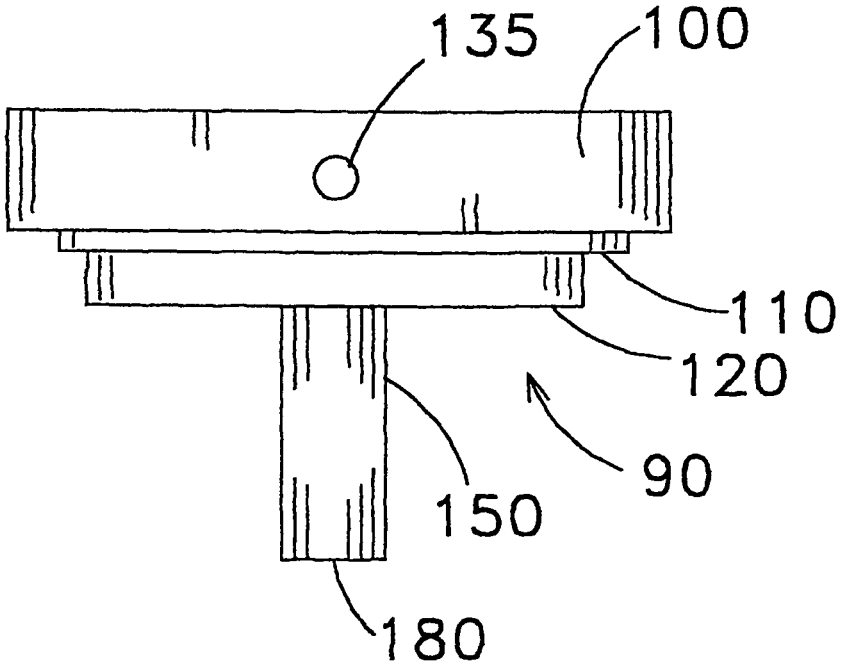
FIG. 2 is a side view of a closure member according to one embodiment of the invention.
Figure 3:
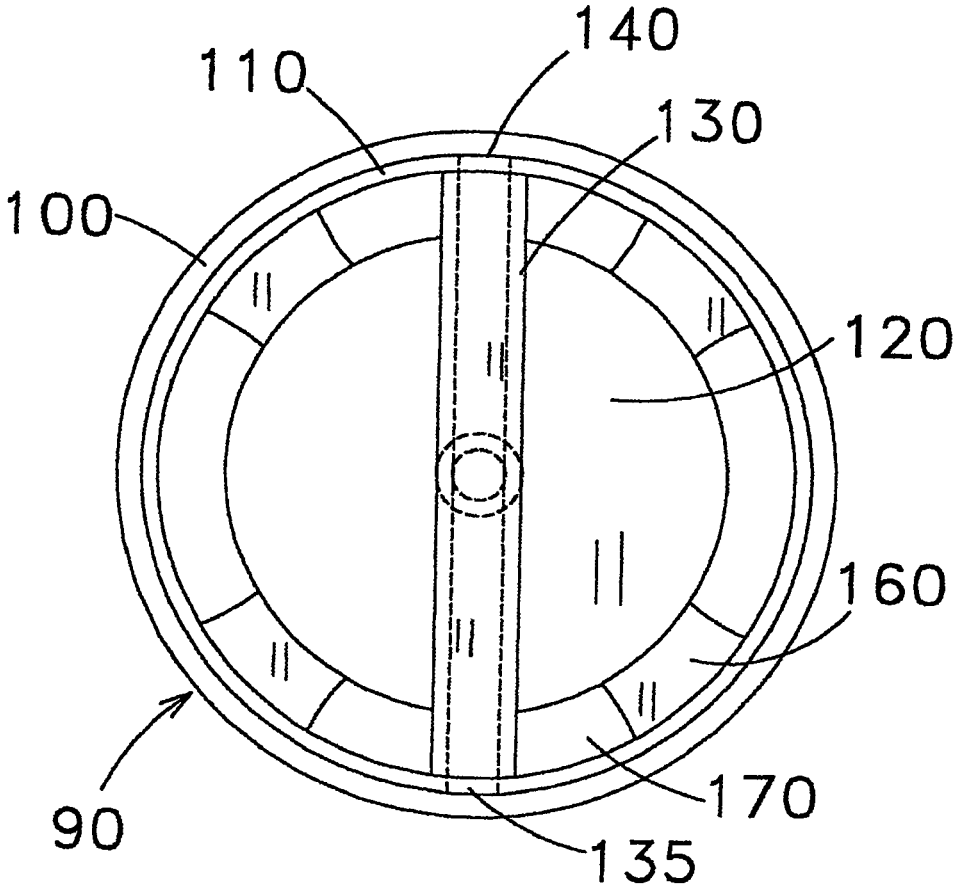
FIG. 3 is a top view of the closure member of FIG. 2.

The present invention will now be discussed with particular reference to FIGS. 2 and 3, which show a closure member 90, according to one embodiment of the invention that may be used in conjunction with a one-way valve, such as the valve 10 of FIG. 1. The closure member 90 is designed to be coupled to the top opening of a bottle or a sippy cup, although one of ordinary skill in the art may adjust the dimensions of the closure member 90 to fit a larger sippy cup container or to an even larger adult sized drinking container.

The closure member 90 includes an outer ring 100 and an inner ring 110. The inner ring 110 fits inside of the baby bottle or the sippy cup, while the outer ring 100 sits on a top lip 95 (shown in FIG. 5) of the baby bottle or the sippy cup container. The closure member 90 includes a central portion 120 and one or more air vent tubes 130 with one or more air vent tube openings 135 and 140 in the periphery of the closure member. Air enters the container via the air vent tube opening or openings 135 and 140 and through the air vent tube 130. The drop tube 150 also has a drop tube opening 180 connected to the interior of valve 10. The air vent tube 130 is operationally connected to a drop tube 150 such that air may pass from outside of the container through the air vent tube openings 135 and 140, through the air vent tube 130, through the drop tube 150, through the valve 10 and through the opening or slit 35 of the valve 10. Air from the outside may pass between the threads of the collar and the threads on the exterior of the baby bottle or the sippy cup container to the air vent tube openings 135 and 140. The closure member 90 also includes supports 160 that provide support to the air vent tube 130 and define openings 170. The openings 170 allow the fluid, such as the formula, juice, milk, etc., to pass from the bottle or sippy cup to the nipple or the spout of the lid during drinking. The supports 160 may be of any shape so long as they provide rigidity to the closure member 90 and provide for the fluids to pass through the openings 170.

Figure 4:
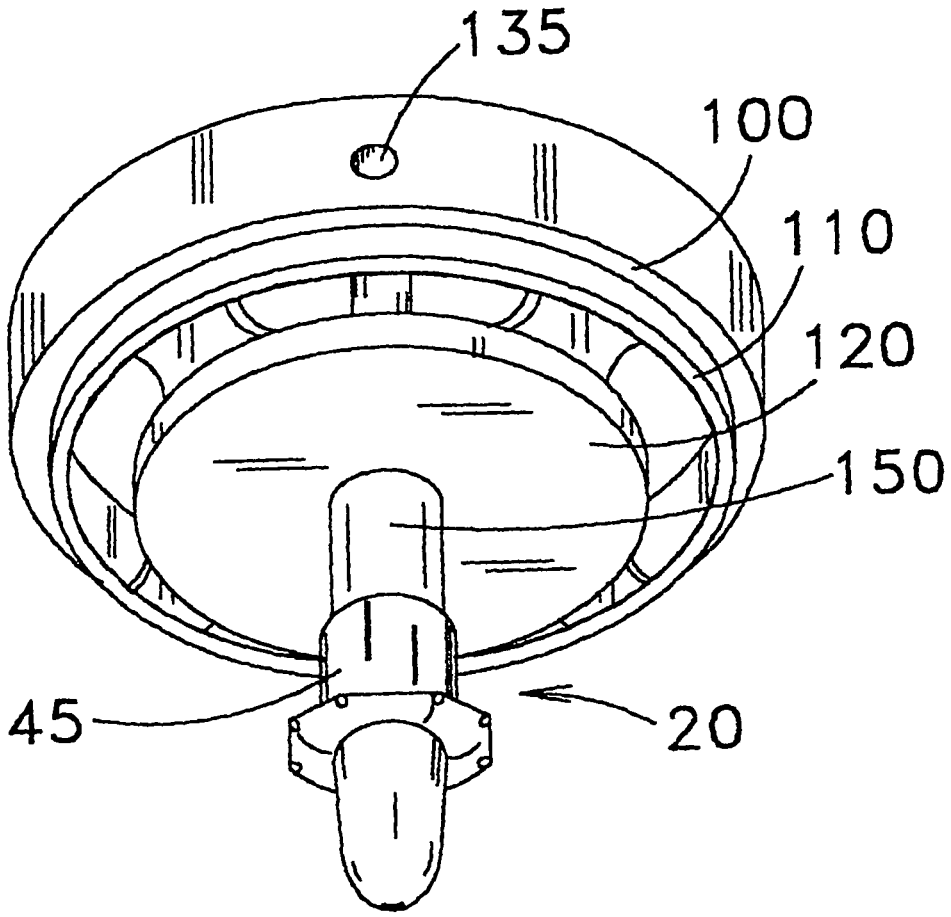
FIG. 4 is a perspective view of a vent system of one embodiment of the invention with the closure member of FIG. 2 and the valve of FIG. 1 in combination.

The vent system of this embodiment will now be described with reference to FIG. 4. As can be seen, the walls 45 of the valve 10 circumscribe the connecting element of the closure member, here drop tube 150 and the drop tube opening 180. The walls 45 are flexed when the drop tube 150 is inserted into the connecting portion 20 such that the walls 45 squeeze on the drop tube 150 with enough force to sealingly retain the valve on the drop tube during use.

Figure 5:
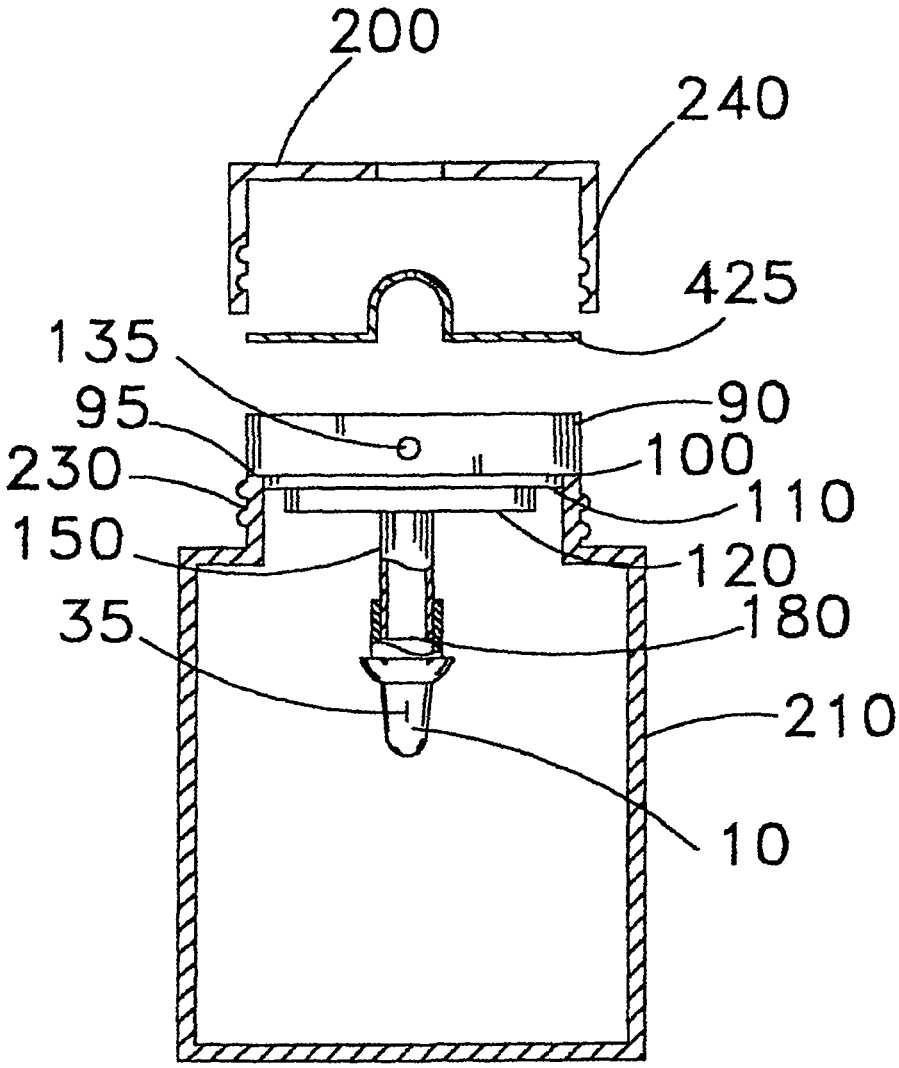
FIG. 5 is a view of the combination of a bottle, the closure member, a collar, a nipple and the valve.

Turning now to FIG. 5, a baby bottle container with the vent system of this embodiment in place is illustrated. In this embodiment, a collar 200 screws down over the top of the closure member 90 and around the neck of the bottle 210. The collar 200 holds a nipple 425 in place. In the alternative, a lid with a flexible spout may be used instead of the nipple 425, or any other conventional liquid outlet for a drinking container.

The air passes in between the threaded region of the neck of the bottle 230 and the threaded region of the collar 240 and enters the air vent tube openings 135 and 140. This may be accomplished by designing each threaded region such that there is sufficient space for the air to exit or, in the alternative, by creating notches or gaps in the threaded region to provide for air flow. From the air vent tube openings 135 and 140, the air passes through the air vent tube 130, the drop tube opening 180, and the air enters the interior of the bottle 210 through the opening 35 in the valve.

The valve and closure member of the present invention may be used with many commercially available baby bottles. The dimensions of the collar, closure member, and nipple may have to be adjusted to accommodate the different bottles to maintain a proper seal.

In other embodiments of the present invention, the valve and the closure member are formed as a single piece. The single piece embodiment operates in substantially the same manner as other embodiments of the present invention.

In a second embodiment, the present invention relates to a drinking container comprising a vent system that removably connects to a drinking container, such as a bottle. The vent system of the second embodiment comprises a closure member, a valve sealingly but removably coupled to the closure member, and an anti-bubble tube removably couplable to the closure member. The vent system attaches or connects to an opening or a mouth of the drinking container and provides passage for air from the exterior of the drinking container to the interior of the drinking container, to allow liquid to freely flow from the drinking container without the drinker applying a suction force, substantially as described above. The anti-bubble tube provides for air entering the inverted container to reach an air pocket formed in the bottom portion of the container, as described above.

The anti-bubble tube reduces the likelihood that the air entering the container will mix with the liquid in the container. The anti-bubble tube connects to the closure member and provides passage from the valve to the bottom of the container. The anti-bubble tube allows air entering the container to pass to the bottom of the container and to an air pocket, which would form there when the bottle is inverted during use. The anti-bubble tube generally encloses the valve, except for an anti-bubble tube opening located near a bottom of the drinking container.

The second embodiment of the present invention will now be described with reference to FIGS. 6 and 7, which show a vent system of the present invention mounted on a drinking container 211. The vent system comprises a closure member 91 according to an alternative embodiment of the invention, an anti-bubble tube 400, and a valve, which may be the valve 10 described previously. The closure member 91 functions similarly to the closure member 90, except closure member 91 includes features discussed below to provide for removable connection between the closure member 91 and the anti-bubble tube 400.

The vent system provides for air to enter a container 211 to compensate for the liquid exiting the container 211 and thus prevent a vacuum from forming within the container 211. The vent system also creates a "diving bell" effect that generally prevents liquid from entering the anti-bubble tube 400 until the "diving bell" effect is no longer maintained. The "diving bell" effect allows the user to vigorously shake the container 211 without leakage, and to fill the container 211 with boiling water without leakage. The container 211 may also be completely filled with liquid, i.e., the container 211 may be filled without limitation. The "diving bell" effect is created by the trapped air in the anti-bubble tube 400 by the valve 10. In a closed state, the valve 10 does not allow air from the anti-bubble tube 400 to exit the container 211. Thus, the trapped air acts as a barrier to liquid entering the anti-bubble tube 400.

Figure 6:
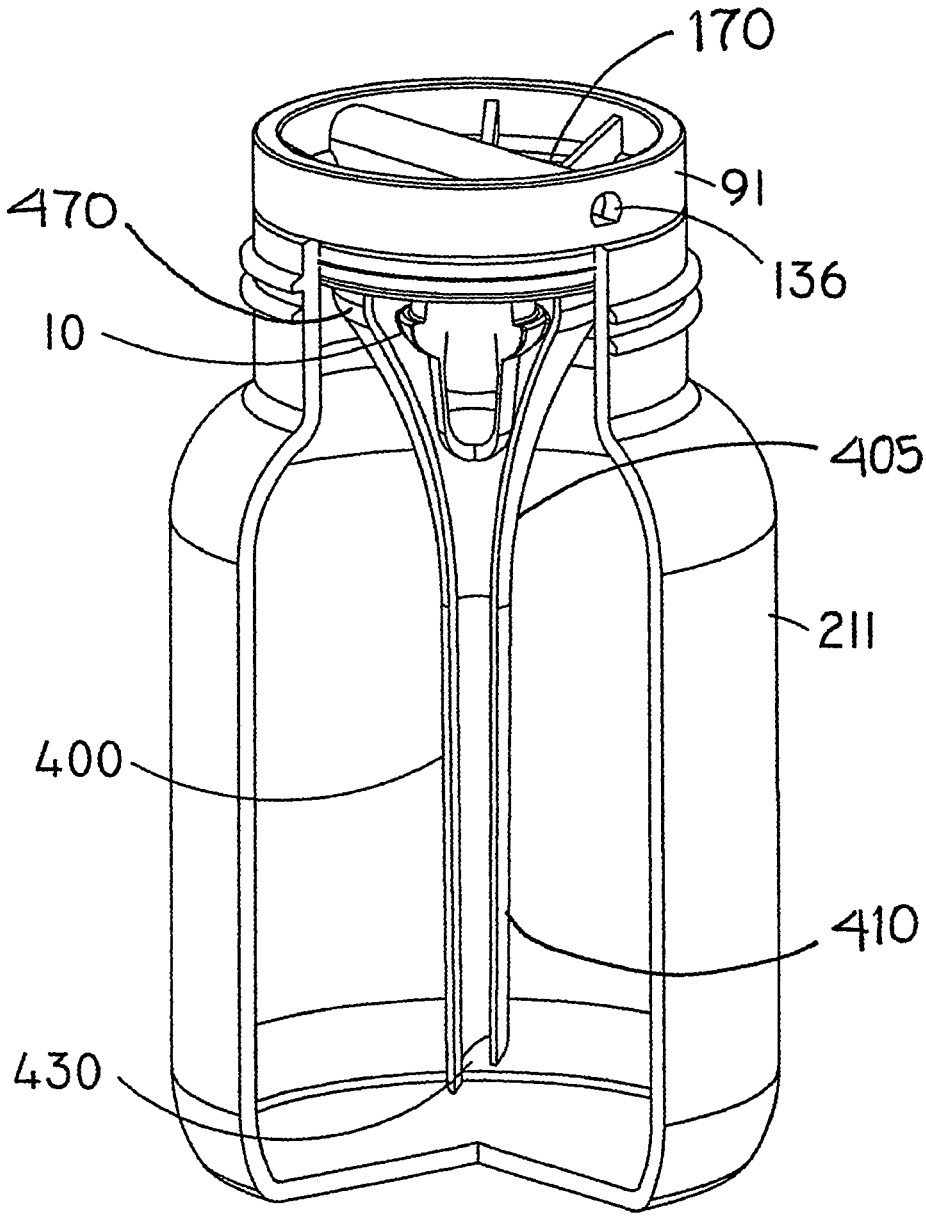
FIG. 6 is a partial sectional view of a bottle with an alternate embodiment of the vent system of the present invention and having an anti-bubble tube.
Figure 7:
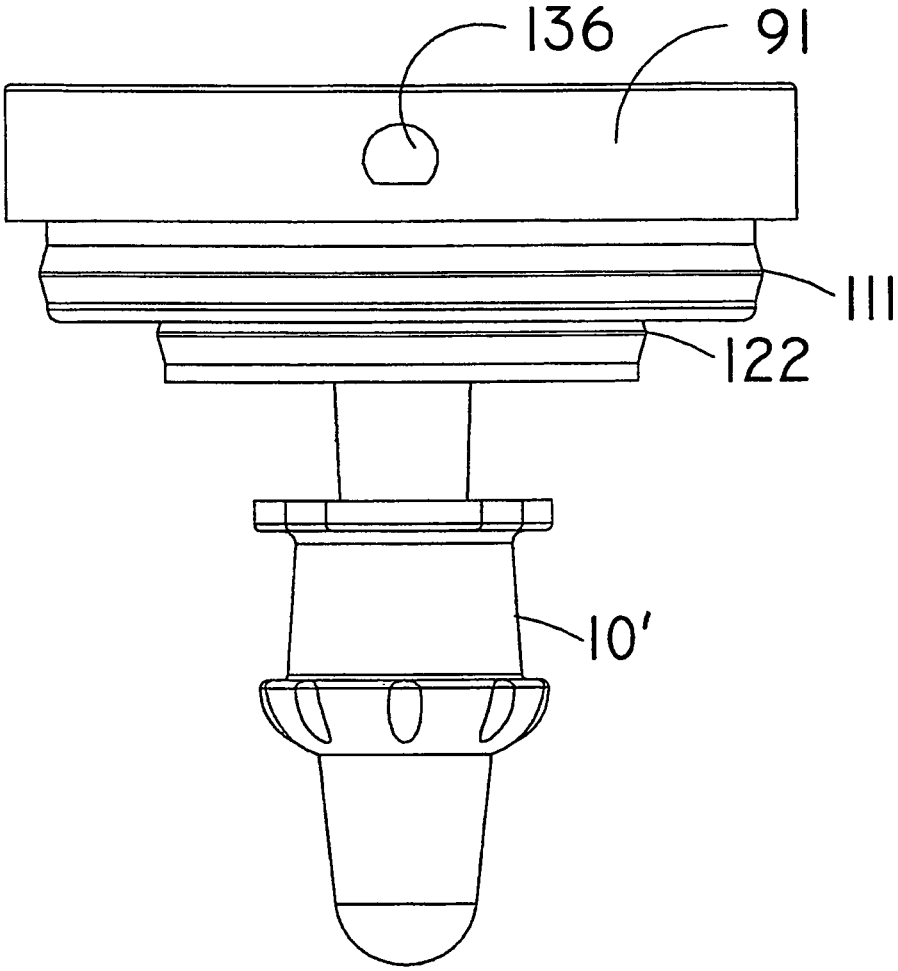
FIG. 7 is a side view of a closure member according to an alternative embodiment of the invention for use with the anti-bubble tube.
Figure 8:
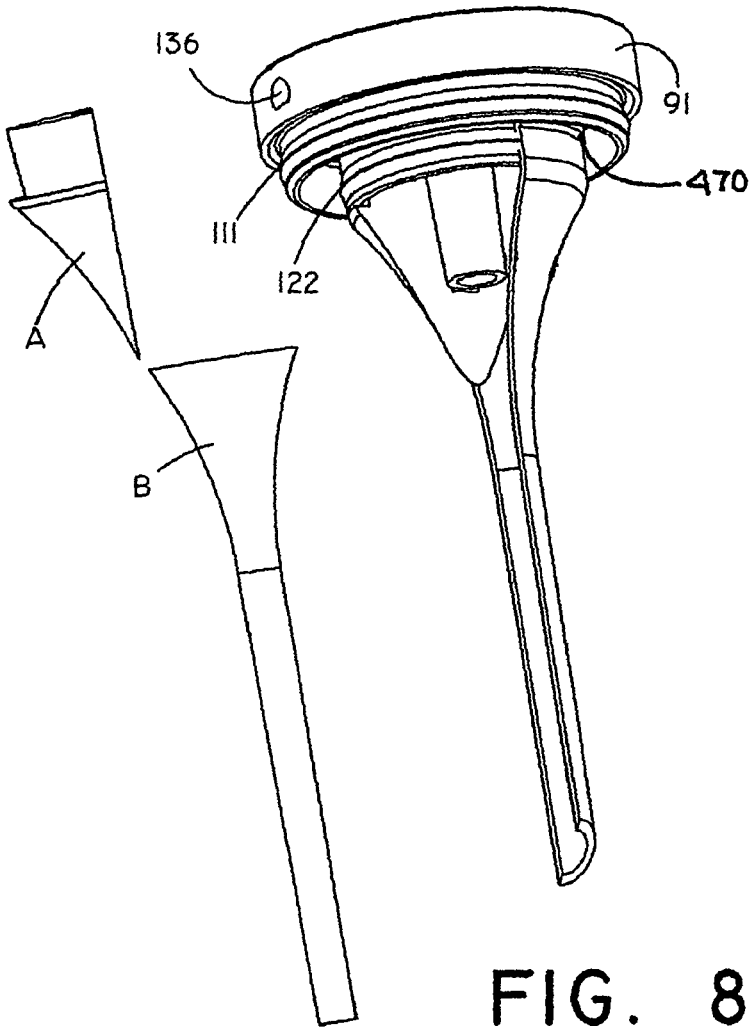
FIG. 8 is a partial sectional view of the anti-bubble tube schematically illustrating its volume.
Figure 9A:
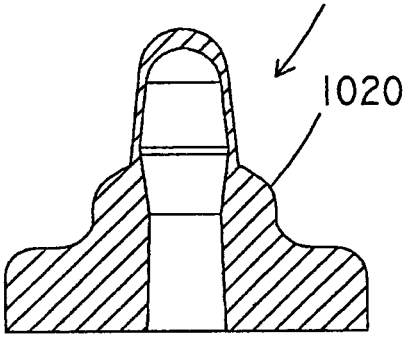
FIGS. 9(A)-(D) are views of one embodiment of a valve for a cup embodiment.
Figure 9B:
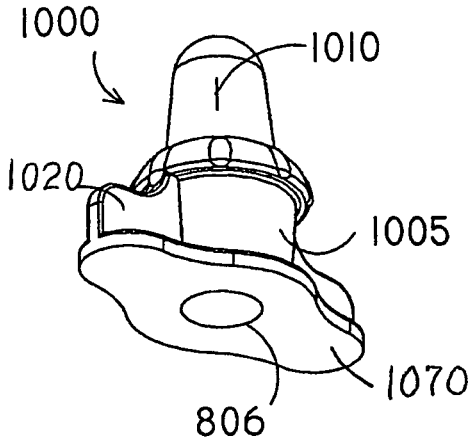
Figure 9C:
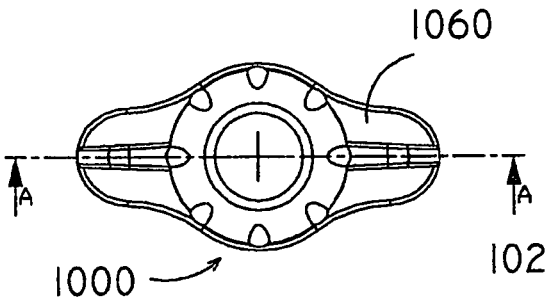
Figure 9D:
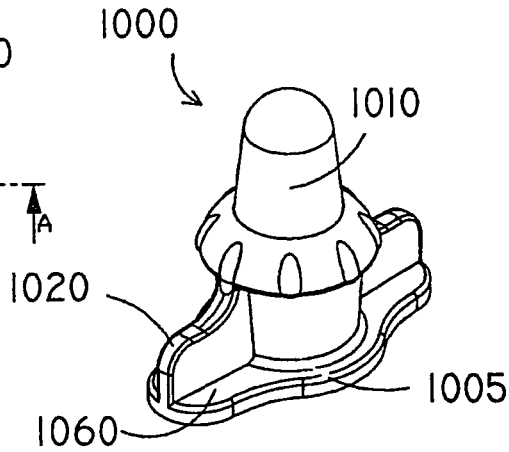
Figure 10A:
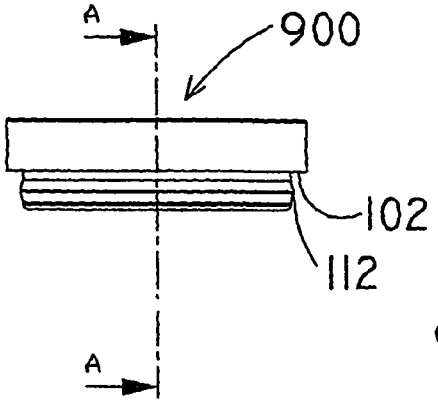
FIGS. 10 (A)-(D) are views of the closure member for the cup embodiment.
Figure 10B:
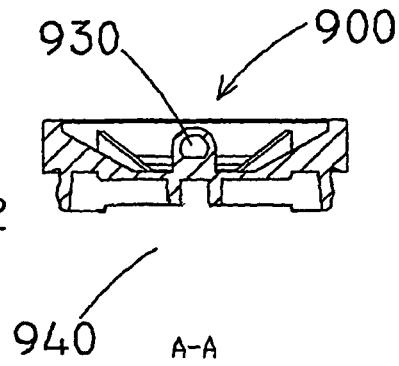
Figure 10C:
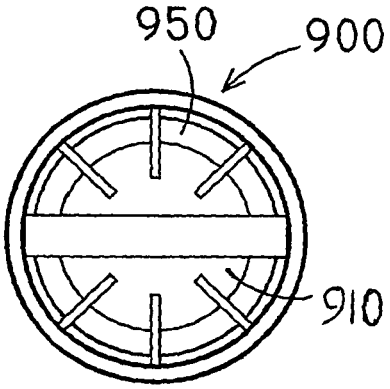
Figure 10D:
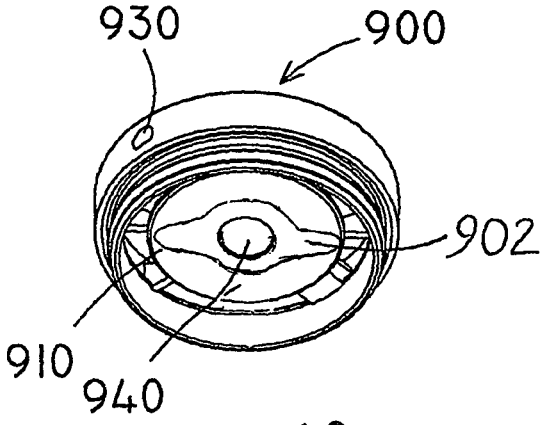

In the embodiment of FIG. 6, the anti-bubble tube 400 is shown comprised of an upper section 405 and a lower section 410. The upper section 405 surrounds the valve 10 and the lower section 410 extends nearly the length of the container 211. The volume of the lower section 410 is greater than the volume of the upper section 405. Relative volumes for the upper section 405 and the lower section 410 are shown schematically in FIG. 8. As can be seen in FIG. 8, the volume B for the lower section 410 is larger than the volume A for the upper section 405. The anti-bubble tube 400 connects to the closure member 91. FIG. 7 is a side view of a closure member according to an alternative embodiment of the invention for use with the anti-bubble tube. Closure member 91 includes a sealing ring 111 for sealing engagement with the inner surface of the neck of the drinking container. A circular opening 470 of the upper portion 405 of the anti-bubble tube circumscribes the central portion 122 of the closure member 91.

During drinking, the valve 10 allows air to enter the bottle in response to an initial vacuum created by the outflow of liquid. This initial vacuum causes air to be sucked into the container to minimize the initial vacuum force therein and maintain the container substantially vacuum-free. At the same time, the valve does not allow liquid to exit the bottle via the vent system and create a mess. As air enters the container 211 through valve 10 and anti-bubble tube 400, this "new" air may displace some of the trapped air, thus forcing the trapped air out the anti-bubble tube 400 and into the air pocket above the liquid level in the container 211. The new air entering the anti-bubble tube maintains the "diving bell" effect.

In this embodiment, a collar, such as the previously described collar 200, screws down over the top of the closure member 91 and around the neck of the container 211. The collar holds a nipple in place, such as the previously described nipple 425. The air passes in between the threaded region of the neck of the container 211 and the threaded region of the collar and enters the air vent tube openings 136. From the air vent tube openings 136, the air passes through the air vent tube, the valve 10, and the anti-bubble tube 400, and the air enters the interior of the container 211.

The anti-bubble tube 400 includes an anti-bubble tube opening 430, which provides access for the air from the valve 10 to the interior of the container 211. The anti-bubble tube 400 connects to the closure member 91 and extends to nearly the bottom portion of the container 211. Preferably, the anti-bubble tube 400 provides for air entering the inverted container 211 to reach an air pocket formed in the bottom portion of the container 211. As air is pulled into the container 211 by removal of a liquid therein through openings 170, the anti-bubble tube 400 acts as a conduit for air from the valve 10 to reach the air pocket in the bottom of the bottle without mixing with the liquid or creating bubbles in the liquid.

Figure 11:
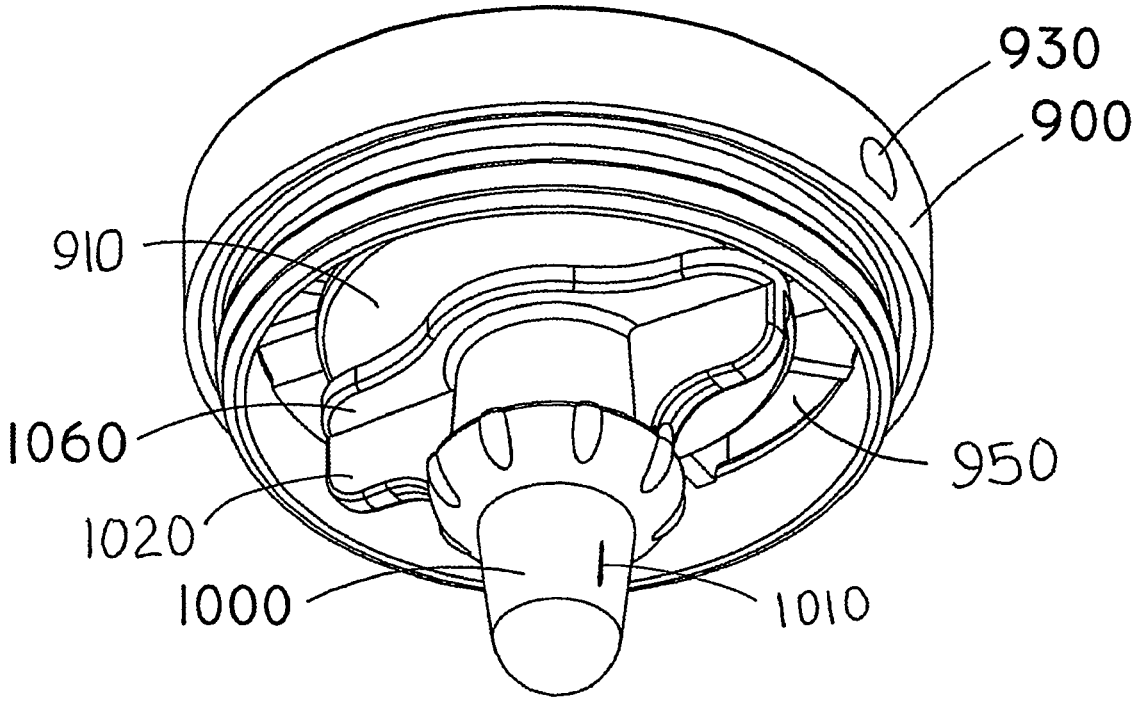
FIG. 11 is a bottom perspective view of the valve of FIG. 9B and the closure member of FIG. 10D for the cup embodiment.

Turning now to FIGS. 9, 10 and 11, a valve 1000 and a closure member 900, according to an alternative embodiment of the invention, are shown. This embodiment is particularly suitable for use with a drinking cup. With particular reference to FIGS. 9A-D, the valve 1000 is shown. The valve 1000 is similar to other valves of the present invention in function, including a connecting portion 1005 and a slit 1010, however the valve 1000 includes a gripping portion illustrated here as curved side portions 1020 and a base 1060. A bottom surface 1070 of the valve 1000 showing an air passage 806 through the valve is shown in FIG. 9B.

The curved side portions 1020 provide the user of the valve 1000 with an extra gripping surface to hold and remove the valve 1000 from the closure member, such as the closure member 900. This feature is especially useful when trying to remove a wet and slippery valve 1000, which could be covered in liquid from the cup or soapy water from the cleaning procedure. Although two curved side portions 1020 of the valve 1000 are shown, other embodiments may include additional gripping surfaces. The curved side portions 1020 and the base 1060 also provide the valve 1000 with extra surface area to increase the overall size of the valve 1000. By increasing the overall size of the valve 1000, certain size standards requisite of childrens' accessories may be satisfied. The curved side portions 1020 provide a large gripping surface at the perimeter of the valve 1000 for the operator to twist when manipulating the valve 1000. The curved side portions 1020 are connected to the base 1060, providing stability and structural integrity to the value 1000.

In this embodiment, the base 1060 also serves as the connecting portion 1005 for coupling the valve 1000 to the closure member 900. For example, the closure member 900 may be provided with a recessed portion 902 complementary to the shape of the base 1060 for snap-fit seating of the valve on the closure member. Alternatively, valve 1000 may include an upstanding tube (not shown) merging from air passage 806 for sealable insertion into air passage 940 in the closure member 900.

With particular reference to FIGS. 10A-D, the closure member 900 is shown. The closure member 900 functions substantially the same as the closure member 90 and the closure member 91 previously described, however, the closure member 900 includes a disk 910 with a flat surface instead of a drop tube. The closure member 900 includes air vent openings 930 that are operationally connected to an air passage 940. The closure member 900 also includes liquid openings 950 to allow liquid to flow from a container connected to the closure member 900 to a spout or nipple mounted on the closure member 900. An outer rim 102 rests on a top rim of the container, while an inner ring 112 seals against the inner wall of the container.

The air passage 940 of the closure member 900 is adapted for operational connection to opening 806 of the connecting portion 1005 of the valve 1000. The valve 1000 includes an opening or slit 1010 to allow air entering the air passage 940 to enter the cup. The disk 910 of the closure member 900 is easy to clean since it is a flat surface. It is also easy to attach the valve 1000 to the closure member 900 owing to the flat surface of the disk 910. FIG. 11 shows the valve 1000 connected to the closure member 900. It will be appreciated that valve 1000 can be coupled to closure member 900 by any conventional manner, including snap fit, or complementary depressions and protrusions, as long as the valve sealingly engages the closure member during use, sufficiently tightly to prevent inadvertent release during use, but is easily removable for cleaning.

In an alternative embodiment of the invention, the vent system comprises a two part closure member. In the illustrated embodiment, the closure member includes a disc portion and a base portion that operate together to allow liquid to flow to a nipple or a spout of the container and to also allow air to enter the container. The base portion is coupled to or includes a valve that allows air to enter the interior of the container, but prevents liquid from exiting the container via the vent system. A preferred embodiment of the base portion includes a duck-bill valve, which is sensitive to fluctuations in pressure. In another preferred embodiment, the valve is integrally formed with the base portion. An optional anti-bubble tube may be used with this vent system.

This embodiment of the present invention will now be discussed with reference to FIGS. 12, 13(A), and 13(B), which show an alternative vent system 215 that may be used in conjunction with a container, such as a bottle or a sippy cup. Vent system 215 includes a base portion 305 and a disc portion 310. The disc portion 310 and the base portion 305 cooperate to form both the air vent channels and the liquid openings. The air vent channels allow air to enter the valve and further into the interior of the container, while the liquid openings allow liquid to exit the drinking container and into the interior of the nipple or the spout.

In general, the base portion comprises the valve, a plurality of base liquid openings, and a plurality of base vent grooves. The base portion 305 of the vent system 215 includes an outer ring 505 and an inner ring 510. The inner ring 510 fits inside of the container, while the outer ring 505 sits on a top lip (not shown) of the container. Inner ring 510 is preferably, slightly angled to the periphery of the base portion 305 to create a seal against the inside of the container. The optional anti-bubble tube connects to the base portion and generally encloses the valve except for an anti-bubble tube opening. The valve is essentially hollow and communicates with the base vent channels to allow air to pass into the container. The valve includes an opening or slit that provides passage for air into the interior of the container.

The disc portion 310 and the base portion 305 are complimentary in shape, i.e., the disc portion and the base portion function together to assist in the venting of the drinking container. The base portion 305 further comprises the plurality of base vent grooves. The base vent grooves 415 are a recessed portion of the base portion 305 that connect the valve to the periphery of the base portion where vent tube openings are located. Air vent tubes 335, to allow air to pass from the atmosphere surrounding the drinking container to the interior of the drinking container, are formed by placing the disc portion 310 over base vent grooves 415, thus creating vent tubes for air to enter the base portion and ultimately the valve and the interior of the container. The disc portion 310 forms and seals a top portion of the air vent tubes 335. When the disc portion is placed on the base portion, the air vent tubes are fully defined by the base vent tubes and a bottom surface of the disc portion, and thus the air vent tubes are sealed from the liquid openings. However, the base vent grooves 415 are fully accessible when the disc portion 310 is removed.

Air enters the container via the vent tube openings 330 and through air vent tubes 335. The air vent tubes 335 are operationally connected to a one-way valve 710 for unobstructed flow of air, such that air may pass from outside of the container through the vent tube openings 330, through the air vent tubes 335, through the valve 710, and through an opening or a slit 715 in the valve. Air from the outside may pass between the threads of the collar and the threads on the exterior of the baby bottle or the sippy cup container to the vent tube openings 330.

The vent system 215 also includes liquid openings 401 which allow the fluid, such as the formula, juice, milk, etc., to pass from the bottle or sippy cup through the vent system 215 and to the nipple or the spout. The liquid openings 401 may be of any shape so long as they provide rigidity to the vent system 215 and provide for the fluids to pass through the liquid openings 401. The liquid openings 401 preferably are formed by a combination of base liquid openings 424 (shown in FIG. 13(B)) and disc liquid openings 432. The base liquid openings 424 and the disc liquid openings 432 may vary in structure. The plurality of disc liquid openings cooperates with the plurality of base liquid openings to create the liquid openings. The base liquid openings and the disc liquid openings are preferably complimentary in shape. This provides stability to the vent system and seals liquids from the air vent channels. This sealing prevents liquids from entering the air vent channels and reduces leaking.

Figure 12:
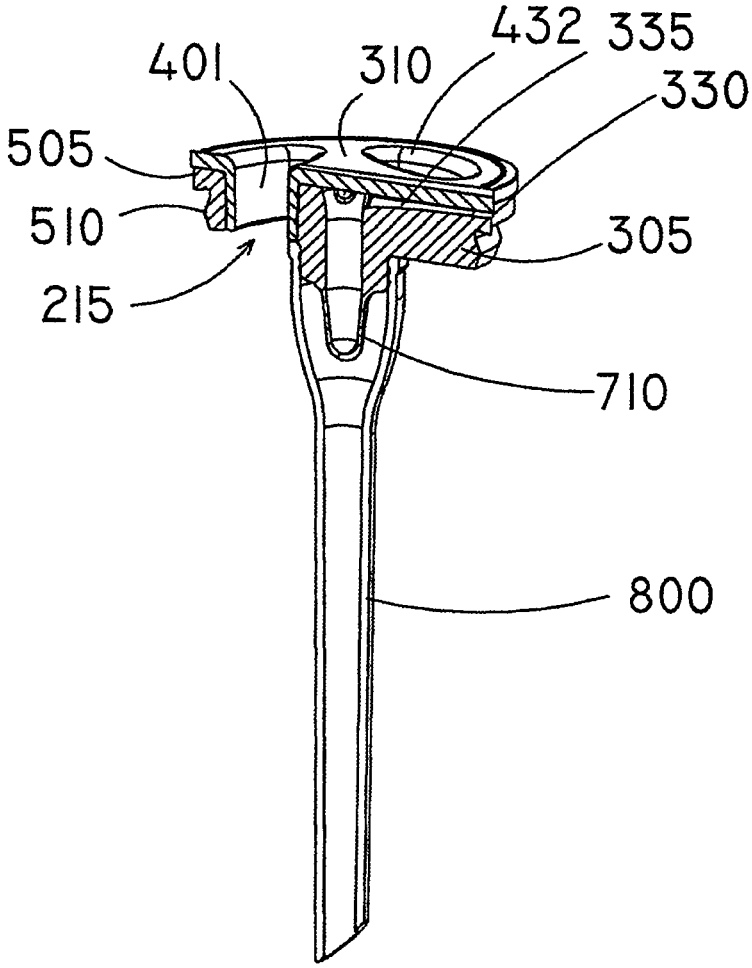
FIG. 12 is a sectional view of a vent system according to a further embodiment having a closure member including a disc portion and a base portion.
Figure 13A:
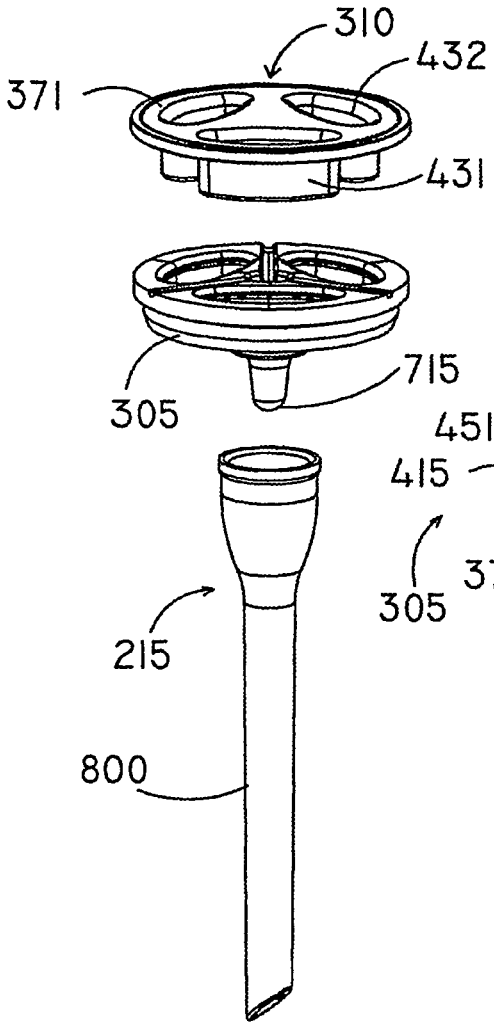
FIG. 13(A) is an exploded view of the vent system of FIG. 12.
Figure 13B:
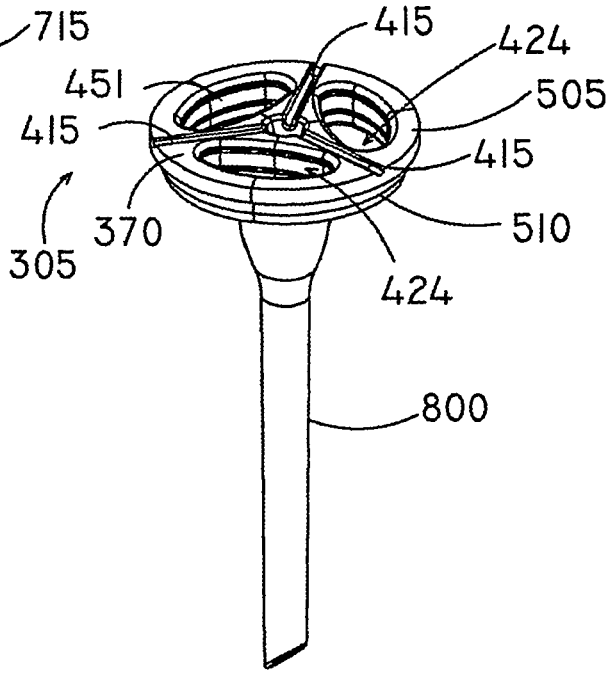
FIG. 13(B) is an assembled view of the vent system of FIG. 12 with an anti-bubble tube.

In the embodiment of FIGS. 12 and 13A, the disc portion 310 further includes a plurality of disc liquid openings 432. Each disc liquid opening 432 includes a descending member 431 that defines the disc liquid opening 432 and extends below a top surface 371 of the disc portion 310. Similarly, the base liquid openings are defined by base liquid opening channels 424 that extend below a top surface of the base portion and extend through at least a portion of the base portion. The descending member 431 of the disc portion 310 is received by the base portion, i.e., the descending member seals flush against a surface 451 of the base liquid opening channels 424 of the base portion 305. This sealing of the complementary disc liquid opening and the complementary base liquid opening stabilizes the disc portion on top of the base portion and prevents liquid from entering the air vent channels.

The valve 710 allows air to enter the bottle to minimize a vacuum formed in the container, but it does not allow liquid to exit the bottle via the vent system 215 and create a leak. The valve 710 includes the valve opening 715. According to a preferred embodiment, the valve 710 is integral to the base portion 305, i.e., the base portion 305 and the valve 710 are formed as a single unit, although, alternatively, the valve 710 may be coupled to the base portion 305 in any manner. During use of the vent system 215, the valve 710 generally protrudes into the container. According to one embodiment of the invention, the base portion includes an indented region for an anti-bubble tube 800 to circumscribe and attach to the base portion 305. The anti-bubble tube 800 provides for air entering the inverted container to reach an air pocket formed in the bottom portion of the container, as described above.

Figure 14A:
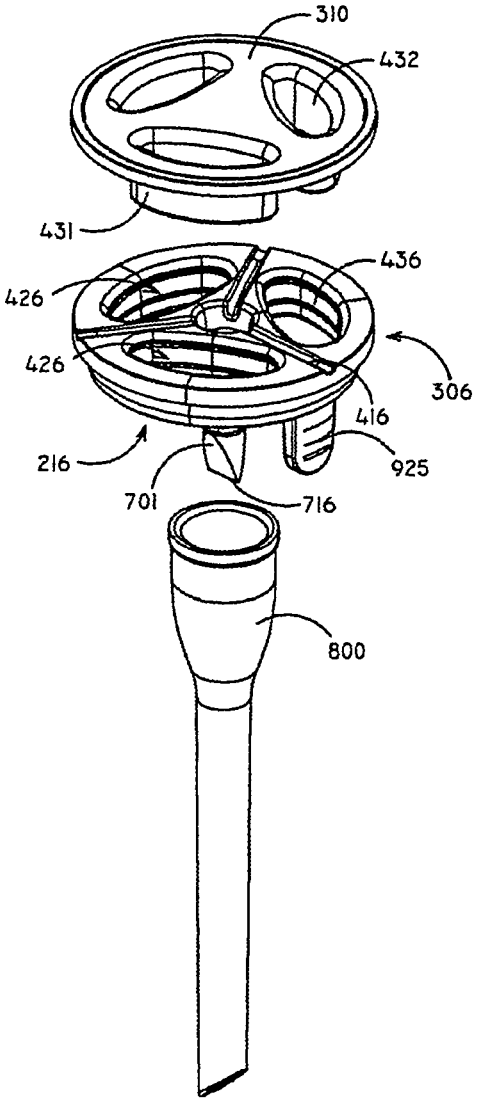
FIG. 14(A) is an exploded view of a closure member of a further embodiment having a disc portion, a base portion, and an anti-bubble tube.
Figure 14B:
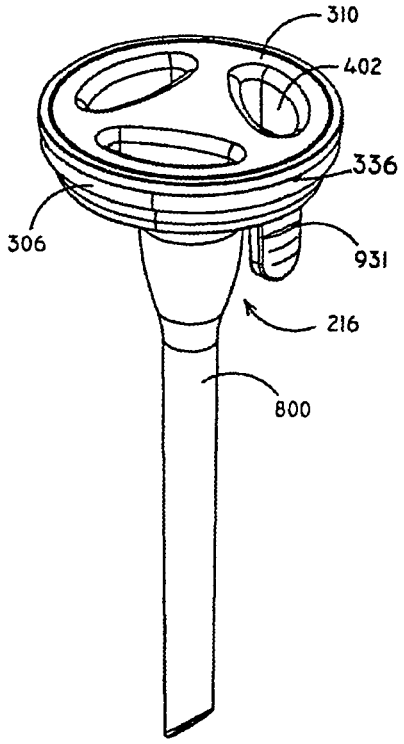
FIG. 14(B) is an assembled view of the disc portion, the base portion of the embodiment of FIG. 14(A), and the anti-bubble tube.
Figure 15:
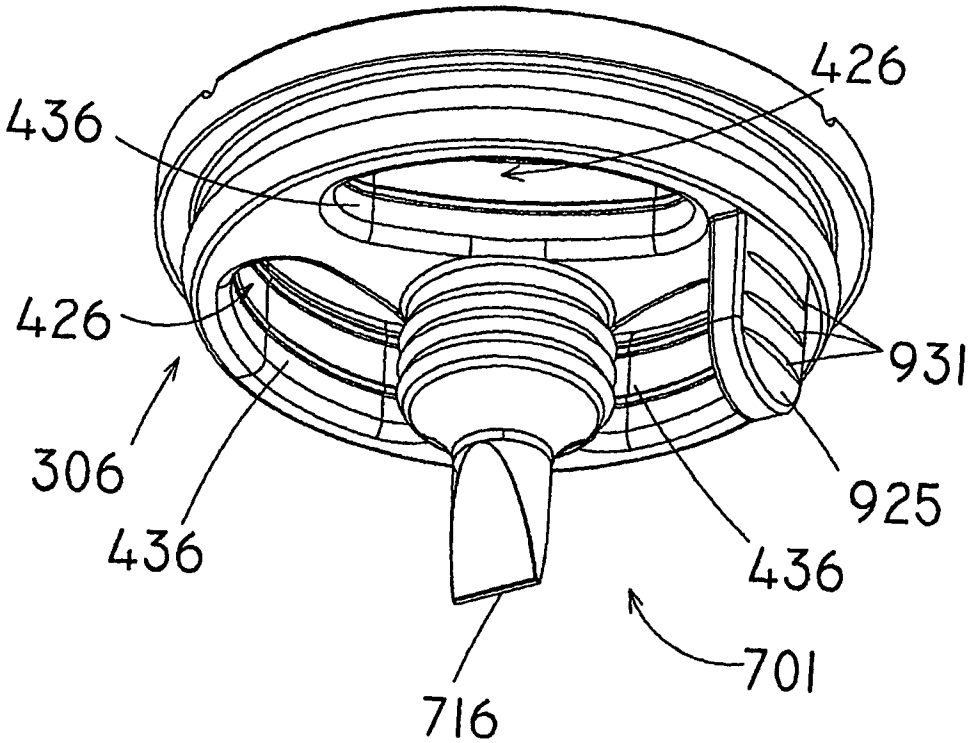
FIG. 15 is a perspective view from beneath the base portion of the embodiment of FIGS. 14(A)-(B).

A vent system 216 according to an alternative embodiment of the invention, also including a two-part closure member, is shown in FIGS. 14(A), 14(B), and 15. The vent system 216 includes a closure member having the disc portion 310 discussed above, and an alternative base portion 306. The vent system 216 functions in the same general same manner as the vent system 215. However, the vent system 216 comprises the base portion 306 having a duck-bill valve 701. The duck-bill valve 701 comprises a slit 716 for the passage of air. The duck-bill valve provides functional advantages, in that it is a more sensitive valve. Thus, it both opens faster under very light vacuum to permit drinking, and closes faster and more strongly under external air or liquid pressure. The duck-bill valve 701 communicates with the air vent tubes 336 to allow air to enter the container. According to a preferred embodiment, the base portion 306 and the duck-bill valve 701 are integrally formed, most preferably of silicone.

A tab 925 on the base portion 306 provides the user a region to grasp on the base portion 306 when pulling or removing the base portion 306 from the disk portion 310. The tab 925 may include ridges 931 to provide a frictional gripping surface. In use or in cleaning, the base portion 306 may be covered in a fluid such as milk or a cleaning solution, and it is helpful for the user to have the tab 925 to grasp and ease the removal of the base portion 306 from the disk portion 310. Air vent tubes 336 (shown in FIG. 14(B)) are formed by placing the disc portion 310 over one or more base vent grooves 416 of the base portion 306. The base vent grooves 416 are a recessed portion of the base portion 306 that create a channel for air to enter the base portion 306 and ultimately the valve and the interior of the container. The base vent grooves 416 are fully accessible when the disk portion 310 is removed. When the disc portion 310 is placed on the second base portion 306, the liquid openings 402 are sealed from the air vent tubes 336 and provide passage for the liquid to the nipple or spout. As shown in FIG. 14(A), the base liquid openings 426 and the disc liquid openings 432 of the disc portion 310 are complementary and their joining stabilizes the vent system 216. In particular, the descending member 431 of the disk portion 310 seals against a surface 436 of base liquid openings 426 of the base portion 306. In this embodiment, the base portion 306 comprises three base liquid openings 426.

The vent systems having a two-part closure member are easily assembled and disassembled by the user. Importantly, the base portion and disc portion, when disassembled, are easily cleaned, since nearly all of their surfaces which form the air vent channels and liquid openings are fully accessible and may be cleaned without any specialized equipment. Importantly, the air vent tubes are completely open and accessible for cleaning when the disc portion and the base portion are disassembled. This is essential for optimum hygiene. The air vent tubes may be visually inspected to ascertain and ensure their cleanliness, which provides reassurance to the user that a clean bottle is being given to the baby.

In some embodiments of the invention, the anti-bubble tube 800 may include a heat sensor portion of a thermally reactive material, such as produced from microencapsulated temperature sensitive plastics. These plastics use color change to indicate specific temperature changes of liquid inside the container.

The vent system may be made from a variety of plastic/rubber materials, such as silicone and thermoplastic rubber. The closure member may be made from a variety of plastic/rubber materials, such as thermoplastic rubber. An especially preferred material for the vent system is silicone since it is easy to clean and safe for use. The anti-bubble tube 400 is preferably made from polypropylene as it may be subject to high temperatures, such as boiling water for sterilization. Polypropylene is also easy to clean.

As discussed and defined above, all of the embodiments of present invention operate in an essentially vacuum-free and non-leak manner. Certain embodiments described herein additionally operate in a non-spill manner.

As evident from the foregoing description, certain aspects of the present invention are not limited by the particular details of the examples illustrated herein, and it is therefore contemplated that other modifications and applications, or equivalents thereof, will occur to those skilled in the art. It is accordingly attended that all claims shall cover all such modifications and applications that do not depart from the spirit and the scope of the present invention.

What is claimed is:

1. A vent system for a drinking container, the vent system comprising:

a single member closure member adapted and configured for mounting between an open top of the drinking container and a liquid outlet member, said closure member including:

an integrally formed tubular connecting element;

at least one air vent tube, extending from the periphery of said closure member to said connecting element and having at least one air vent tube opening in said periphery;

an air passage therethrough defined by the connecting element, said air vent tube and said at least one air vent tube opening, to allow the passage of air from outside the container to an interior of the container when a vacuum is formed inside the container; and a one-way valve sealingly and removably coupled to said connecting element and operatively connected to said air passage, and extending into said container, for permitting passage of air from outside the container into said interior of the container through said more than one air vent tube opening, said air vent tube, said connecting element and said valve, only when a vacuum is formed inside the container and preventing flow of liquid from the interior of the container to outside the container through said vent system.

2. The vent system according to claim 1, wherein said valve includes a circular opening adapted and configured to receive a connecting element of said closure member, said connecting element being operationally connected to said air vent tube, such that air may pass from outside the container through the air vent tube and said connecting element and through said valve.

3. The vent system according to claim 1, wherein said closure member further comprises at least one liquid opening to allow passage of liquid from the interior of the container through said open top.

4. The vent system according to claim 1, and further comprising an anti-bubble tube extending to nearly a bottom of portion of the container, said anti-bubble tube being releasably coupleable to said closure member and circumscribing said valve, wherein the anti-bubble tube and the valve trap a volume of air therebetween, so as to create a "diving bell" effect within the anti-bubble tube.

5. The vent system according to claim 4, wherein said anti-bubble tube comprises a heat sensor of a thermally reactive material to indicate a temperature of a liquid in the container.

6. The vent system according to claim 4, wherein said anti-bubble tube has a lower section and an upper section, wherein the upper section generally surrounds the valve, and wherein the lower section has a larger volume than the upper section.

7. The vent system according to claim 1, wherein said valve further includes a connecting portion adapted and configured for sealingly engaging said connecting element on said closure member during use, sufficiently tightly to prevent inadvertent release during use, and for easy removal for cleaning.

8. The vent system according to claim 7, wherein said valve further includes a gripping portion for ease of gripping during removal of said valve from said closure member.

9. The vent system according to claim 1, further comprising a drinking container comprising:

a liquid outlet member; and a collar, wherein the collar is threadably connected to the container for sealing the liquid outlet member against the closure member, wherein a threaded region of a neck of the bottle and a threaded region of the collar are adapted and configured to allow air to pass therebetween and enter said air passage.

10. A method for forming a drinking container, the method comprising:

forming a single piece closure member configured for mounting said closure member between an open top of the drinking container and a liquid outlet member, said closure member including an integrally formed tubular connecting element;

forming, in said closure member, at least one air vent tube, having more than one air vent tube opening in a periphery of said closure member;

forming an air passage, defined by the connecting element, said air vent tube and said more than one air vent tube opening, through said closure member, to allow the passage of air from outside the container to an interior of the container when a vacuum is formed inside the container; and sealingly and removably coupling a one-way valve to said connecting element, said valve being operatively connected to said air passage, and extending into said container, for permitting passage of air from outside the container into said interior of the container through said more than one air vent tube opening, said air vent tube, said connecting element and said valve, only when a vacuum force is created inside the container and preventing flow of liquid from the interior of the container to outside the container through the closure member;

so as to form a substantially vacuum-free, non-leak drinking container.

11. The method according to claim 10, further comprising mounting an anti-bubble tube on said closure member circumscribing said valve, wherein said anti-bubble tube and said valve trap a volume of air therebetween so as to create a "diving bell" effect within the anti-bubble tube.

12. The method according to claim 11, wherein said anti-bubble tube is adapted and configured, when said container is inverted, to guide air entering the container to an air pocket formed in a bottom portion of the container, wherein the air pocket is created by partially emptying the container.

13. The method according to claim 12, wherein the anti-bubble tube is adapted and configured to provide passage for air directly to said air pocket, and the air is not allowed to mix with the liquid in the container or create air bubbles in the liquid.

* * * * *